United States Patent [19]

Salvat et al.

[11] 4,143,377

[45] Mar. 6, 1979

[54] OMNIDIRECTIONAL ANTENNA WITH A DIRECTIVITY DIAGRAM ADJUSTABLE IN ELEVATION

[75] Inventors: François Salvat; Jean Bouko, both of Paris, France

[73] Assignee: Thomson-CSF, Paris, France

[21] Appl. No.: 855,232

[22] Filed: Nov. 28, 1977

[30] Foreign Application Priority Data

Nov. 30, 1976 [FR] France ..... 76 36071

[51] Int. Cl.[2] ..... H01Q 13/04

[52] U.S. Cl. ..... 343/755; 343/773; 343/783

[58] Field of Search ..... 343/753, 754, 755, 773, 343/774, 775, 783

[56] References Cited

U.S. PATENT DOCUMENTS 2,599,896 6/1952 Clark et al. ..... 343/773

*Primary Examiner*—Eli Lieberman

*Attorney, Agent, or Firm*—Karl F. Ross

[57] ABSTRACT

An antenna of the discone type is omnidirectional in bearing and has a diagram whose directivity in elevation can be adjusted. At the apex end of each cone a dielectric disc of predetermined thickness is inserted parallel to the base of the cone concerned. In the central portion of the antenna these two discs create conditions for the propagation of energy which are different from those existing outside the discs, the result being an improvement in the phase pattern in the radiating aperture of the antenna.

4 Claims, 6 Drawing Figures

OMNIDIRECTIONAL ANTENNA WITH A DIRECTIVITY DIAGRAM ADJUSTABLE IN ELEVATION

BACKGROUND OF THE INVENTION

The present invention relates to an omnidirectional antenna and in particular to an antenna which is omnidirectional in the bearing plane and whose radiating diagram or pattern in the elevation plane may exhibit a predetermined directivity.

Such antennas are used, inter alia, in the field of electromagnetic detection and also in that of telecommunications.

Omnidirectional antennas are known and particular mention may be made of those termed "discone" antennas, which consist chiefly of two conical reflectors whose apices are turned towards one another and which are fed through these very apices.

A discone antenna which is omnidirectional in bearing has a diagram whose directivity in the elevation plane is related to the size of the radiating aperture in this plane, and if a radiation diagram having small side lobes is required in the elevation plane, it is necessary for the pattern of illumination to show a small phase error. This is explained by the fact that, if the radiation diagram in elevation is to be very narrow, it is necessary for the radiating aperture to be very large, which results in phase errors in the field distribution across the aperture and causes the side lobes to increase again.

Thus, the error in phase may be reduced provided the radiating aperture is reduced by making the angle of the cones of the antenna smaller, but in this case the reduction in phase error is only achieved at the cost of an increase in the length of the discone. The result is a substantial increase in the physical size of the discone and this has a disadvantageous effect on the weight and bulk of the antenna.

SUMMARY OF THE INVENTION

An object of the invention is to provide an antenna of the discone kind which does not suffer from the restrictions pointed out above.

According to the invention, there is provided an omnidirectional antenna having a diagram in elevation whose directivity can be adjusted, comprising two truncated metal cones whose apices face each other and a waveguide feeding the said antenna through the said apices, two discs of dielectric material of predetermined width and of similarly predetermined thickness arranged parallel to the base of the said truncated cones and at a predetermined distance from their respective apices, thus altering the conditions under which energy is propagated in the part of the antenna situated between the discs as compared with the part of the antenna outside the said discs, whereby a reduction in the phase difference between the central part of the radiating aperture of the said antenna and its edges is achieved in the said aperture.

BRIEF DESCRIPTION OF THE DRAWINGS

The invention will be described in greater details with reference to the accompanying drawings in which.

DESCRIPTION OF THE INVENTION

Figure 1:
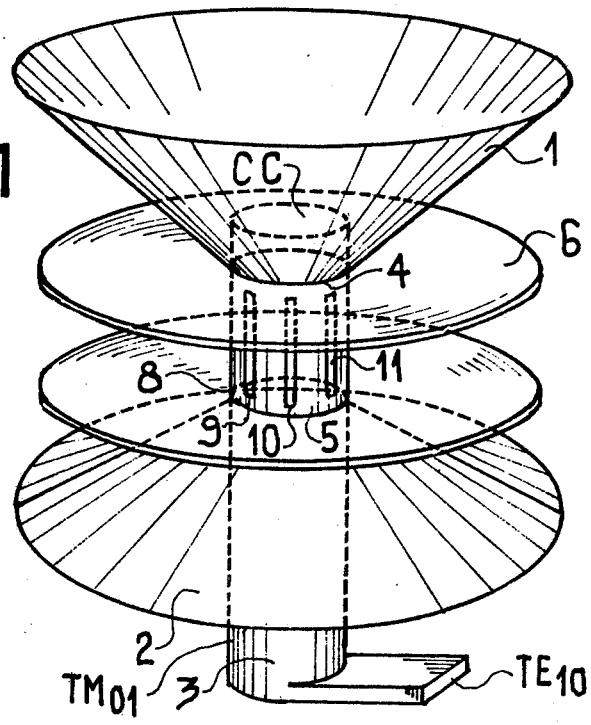
FIG. 1, is a perspective view of an antenna according to the invention.

FIG. 1 shows an omnidirectional antenna according to the invention. It comprises two truncated metal cones 1 and 2 which are attached to a waveguide 3 of circular cross-section which forms the feed guide and which is closed off at one end by a short-circuit CC. The intersections between the truncated cones 1 and 2 and the waveguide 3 are at two cross-sectional planes 4 and 5 which have spaced between them a considerable length of the guide 3. Two discs 6 and 7 of dielectric material are attached to the truncated cones 1 and 2 at the points where these cross-sectional planes 4 and 5 are situated so that the bases of the truncated cones and the surfaces of the discs of dielectric material are parallel and lie perpendicular to the feed waveguide 3. The part 8 of the feed waveguide contains an array of equidistant slots of which only three, 9, 10, and 11, can be seen in the Figure.

In the view shown in FIG. 1, these slots are parallel to the axis of the guide 3. Their orientation may however be different and the slots may be vertical, horizontal or oblique, depending on whether the polarisation of the wave which is used is horizontal, vertical or circular. The mode of excitation would also change, being TM01 in the case of the Figure and TE01 in the case of vertical polarisation.

In the embodiment shown in FIG. 1, where the slots are vertical, the antenna, being formed as just described, radiates with straight horizontal polarisation in bearing and the guide 3 is fed in the radial TM01 mode, the slots being coupled to the guide by means of radial stubs 12 situated beside each slot.

Figure 2:
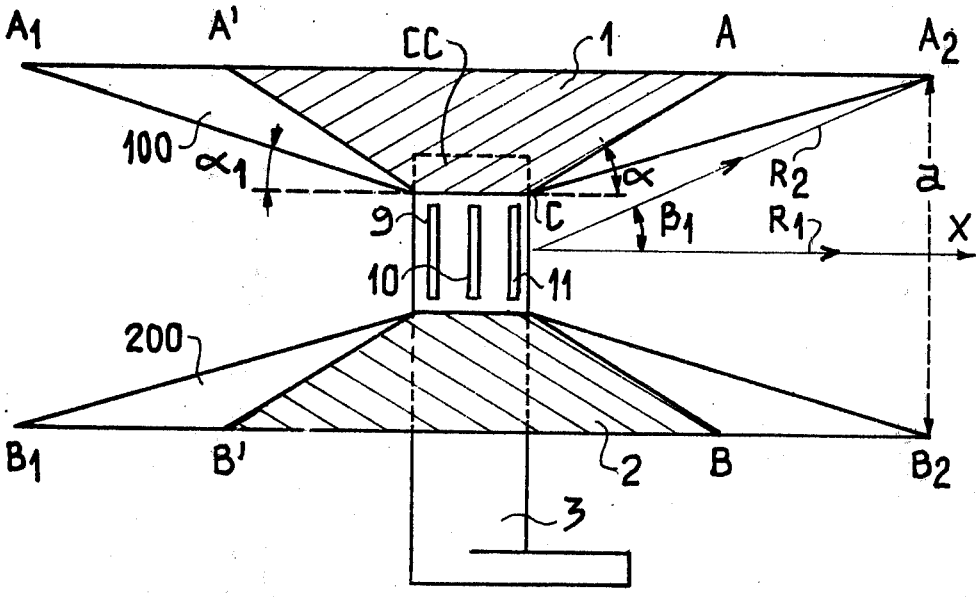
FIG. 2, is a diagrammatic view of a conventional discone antenna and of the discone part of the antenna according to the invention, which is smaller in size.
Figure 3:
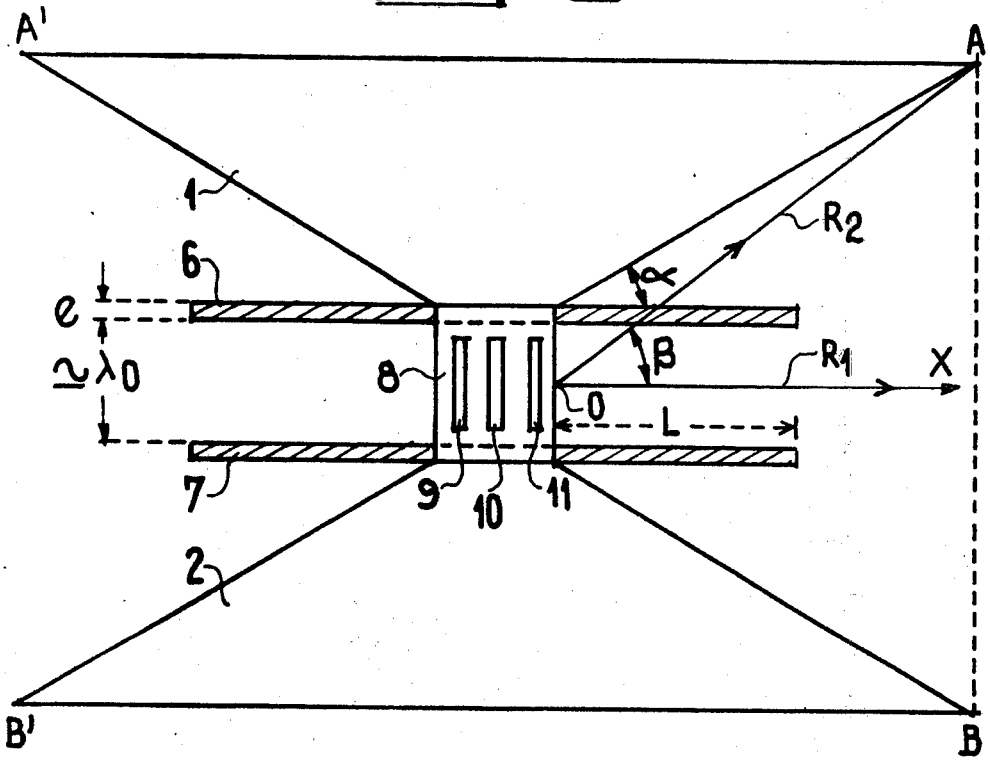
FIG. 3, is a schematic plan view of an antenna according to the invention.

In FIG. 3, which is a diagrammatic view of the antenna of FIG. 1, an angle $\alpha$ is shown which is formed by a generatrix of a cone 1 which is part of the antenna concerned, with the surface of the associated dielectric disc 6. This angle is generally made smaller than or at most equal to 45°. If there were no discs 6 and 7 of dielectric material, the antenna, as is shown diagrammatically in FIG. 2, would then be formed solely by truncated metal cones 100 and 200 and would have large side-lobes (outline IV in FIG. 5). To restrict the size of the side-lobes it would be necessary to reduce the angle $\alpha$ to a value less than or at most equal to 20°. If this were the case the length of the antenna as measured across the diameter of the base surface of a truncated cone would then be considerable and would be of the order of at least three times the size of the diameter of the base of a similar truncated cone as shown in FIG. 1. The angle $\alpha_1$ of such a cone is shown in FIG. 2, as also is the size of the conventional antenna, the cones extending out to points $A_1$ and $B_1$ and $A_2$ and $B_2$. In FIG. 2 the cones 1 and 2 (having bases AA' and BB') of an antenna produced in accordance with the invention are shown, though with the dielectric discs omitted from the Figure, to show the substantial difference which there is in the size of the cones.

As regards the operation of this antenna, it may be mentioned that the correction of or compensation for the phase errors in the radiating aperture derives from the difference which exists between the propagation of waves in a conventional discone antenna and the propagation of waves in the case of the invention in the part of such an antenna which is still present and between the discs of dielectric material.

It reference is made to FIG. 2, in which the discs of dielectric material are not shown, it is possible to determine the difference in phase which exits between a central beam R1 and a beam R2 which is propagated towards one extremity of the radiating aperture, such as, for example, point A.

This phase shift may be expressed as, $$\Delta\phi = \frac{2\pi \operatorname{Sin} \beta_1}{\lambda_0} \cdot \frac{a}{2}$$

where $\beta 1$ is the angle which beam R2 forms with the centre axis OX, $\lambda o$ is the operating wavelength, and a is the size of the radiating aperture. Also shown in the Figure is the angle $\alpha 1$ which the edge of one cone of the antenna forms with respect to the centre axis OX. In general, angle $\beta 1$ is larger than angle $\alpha 1$ and where angle $\alpha 1$ is larger than 30°, the phase of the illumination across the radiating aperture AB shows a substantial variation between the centre of the aperture and the edge. In the case of the elevation diagram, this results in a unidirectivity which is less than that expected and which can be expressed as $$\theta = \frac{70\lambda_0}{a}$$

in degrees.

The addition to a conventional discone antenna of the discs of dielectric material 6 and 7 does in fact enable this directivity to be altered so that it tends towards that expected.

The diagram in FIG. 3 of an antenna according to the invention will enable the phase difference which exists between beams R1 and R2 in the new configuration to be established.

As in the previous Figure, beam R1 is a central beam which is propagated along axis OX, while beam R2 is propagated through the disc in the space between the cones of the antenna to an edge A, for example, of the radiating aperture.

The beam R2, which strikes the disc 6, for example at an angle of incidence such that it is able to pass through the dielectric disc without being affected, is subject to a phase lag similar to that to which it would be subject under similar conditions in a discone antenna without dielectric discs. Beam R1 on the other hand, whose angle of incidence is small, is almost totally reflected by the dielectric and its propagation is channelled between the two discs. Because of this it becomes subject to a phase lag as compared with beam R1 in the configuration of FIG. 2.

This phase lag may be assessed as a function of the length L of the discs by assuming that the distance between the discs is of the order of a wavelength, i.e. $\lambda o$.

The phase lag is expressed by:

$$\Delta\phi' = 2\pi L \left(\frac{1}{\lambda_0} - \frac{1}{\lambda_g}\right)$$

where $\lambda g$, the guided wavelength, is determined by $$\lambda_g = \frac{\lambda_0}{\sqrt{1 - \left(\frac{\lambda_0}{2\lambda_0}\right)^2}} = \frac{2\lambda_0}{\sqrt{3}}$$

$$\text{whence } \Delta\phi' = 2\pi L \left(\frac{1}{\lambda_0} - \sqrt{\frac{3}{2\lambda_0}}\right) = \frac{2\pi L}{\lambda_0}\left(1 - \sqrt{\frac{3}{2}}\right)$$

It will be recalled that the phase difference across the radiating aperture AB is:

$$\Delta\phi = \frac{2\pi}{\lambda_0} \operatorname{Sin}\beta \frac{a}{2}$$

The length L is therefore made such that $\Delta\phi = \Delta\phi'$ in order to compensate for the difference in phase.

$$L = \frac{a \operatorname{Sin}\beta}{2 - \sqrt{3}}$$

By selecting the width of the disc, the change in the phase pattern across the aperture has been minimised and directivity conforms to the law:

$$\phi_{-3dB} = \frac{70\lambda_o}{a},$$

which represents the angular extent of the diagram in elevation at −3 decibels where $\theta$ is expressed in degrees.

By way of example, if $\theta_{-3dB} = 20°$ and angle $\beta = 35°$, then L is $7.5\lambda o$.

However, tests which have been carried out have shown that the width L which needs to be selected for the discs is smaller than that indicated by calculation.

Figure 4:
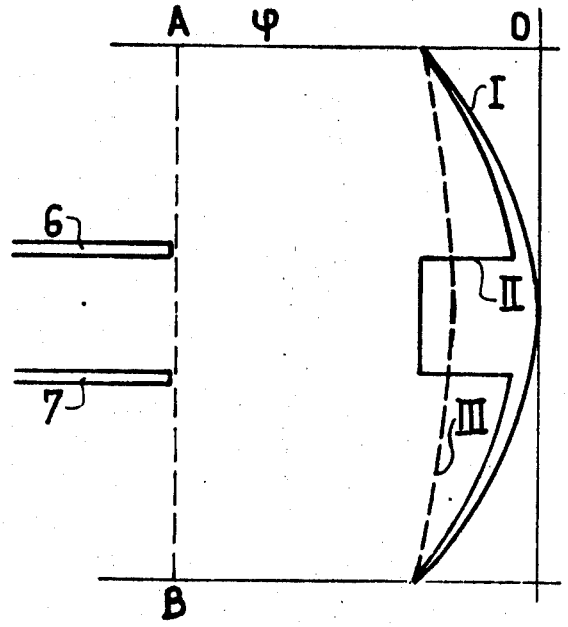
FIG. 4, is a diagram of the phase law across the aperture of the antenna of FIG. 1, FIG. 5, is a view of the radiation diagrams of an antenna according to the invention and of a conventional discone antenna.

FIG. 4 shows the phase pattern across the aperture. Curve 1 shows this pattern in the absence of discs, curve II in the presence of discs, and curve III the corrected phase pattern which is obtained in the case of the invention.

Figure 5:
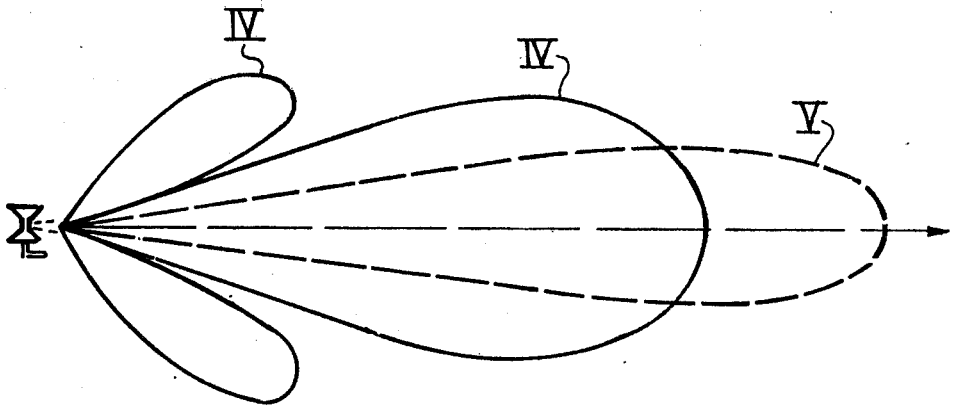

FIG. 5 is a diagrammatic view of the elevation diagrams obtained with a conventional discone antenna and with an antenna according to the invention. Diagram IV, for a normal discone antenna, is relatively wide and has large side-lobes and is fairly far removed from diagram V, which is that obtained from a discone antenna fitted with discs of dielectric material. Diagram V approaches the theoretical diagram.

Figure 6:
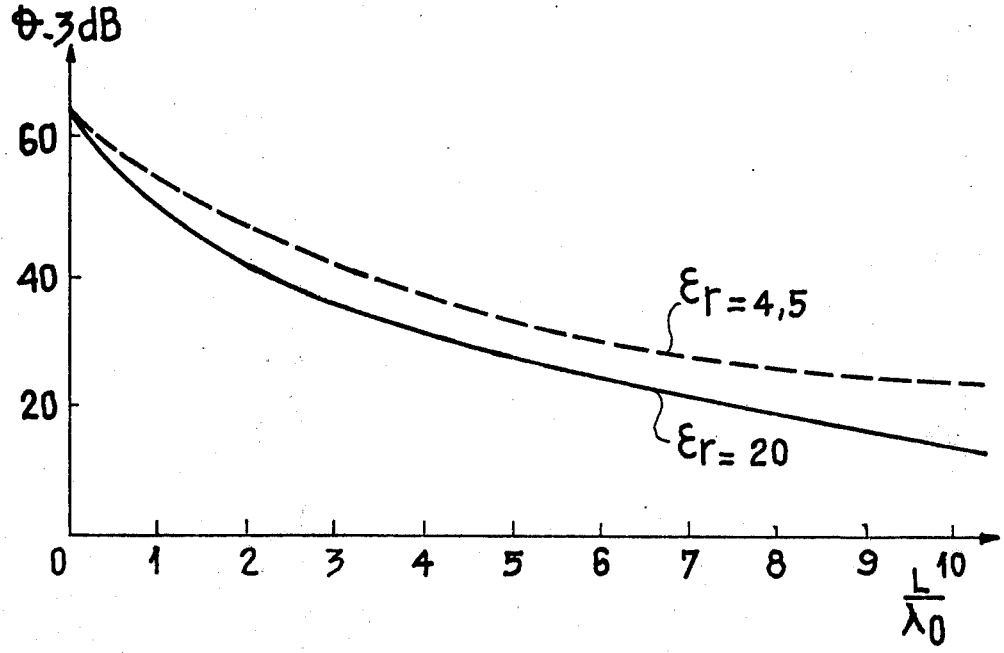
FIG. 6, is a graph showing the width of the diagram in elevation as a function of the ratio between the length of the discs and the wavelength.

FIG. 6 is a graph showing the width of the diagram in elevation (i.e. $\theta_{-3dB}$) as a function of the ratio $L/\lambda o$ where L is the length of a disc and $\lambda o$ the wavelength. The dielectric constant $\epsilon$ of the material used for the discs is taken as a parameter. From this graph, it can be seen that the optimum spacing between the discs is between 0.75 and 1.2 $\lambda o$ and the thickness e of the discs is taken by way of example to be such that $$e \leqq \frac{\lambda o}{10} \frac{1}{\sqrt{\epsilon - 1}}$$

It may also be mentioned in the context of the present invention that if the thicknesses of the discs are made different this causes the line of maximum radiation in the elevation diagram to tilt by an amount which may be as much as several degrees. The tilt takes place towards the disc whose thickness is smaller.

There has thus been described an antenna which is omnidirectional in bearing and which has a radiation diagram in elevation which is variable, narrow and free of side lobes.

What is claimed is:

1. An omnidirectional antenna having a diagram in elevation whose directivity can be adjusted, comprising two truncated metal cones whose apices face each other, a waveguide feeding the said antenna through the said apices, two discs of dielectric material of predetermined width and of similarly predetermined thickness arranged parallel to the base of the said truncated, cones, and at a predetermined distance from their respective apices, determining in said antenna, two parts in which the energy is propagated, a first part termed a central part in which the energy is propagated through said discs, a second part outside said discs, said discs differently altering the propagation of energy in said parts, resulting in the radiating aperture of said antenna, in a reduction of the phase differences between the central part of said radiating aperture and its edges.

2. An omnidirectional antenna according to claim 1, wherein the optimum spacing between the discs is between 0.75 and 1.4 times the operating wavelength.

3. An omnidirectional antenna according to claim 1, wherein the optimum width of the disc is between 5 and 10 wavelengths.

4. An omnidirectional antenna according to claim 1, wherein a difference in thickness between the discs results in the line of maximum radiation in the diagram tilting towards the disc of smaller thickness by an amount of the order of a plurality of degrees.

* * * * *